United States Patent [19]

Hughes

[11] 4,273,402

[45] Jun. 16, 1981

[54] ELECTRICAL CONNECTOR RECEPTACLE

[75] Inventor: Donald W. K. Hughes, Mechanicsburg, Pa.

[73] Assignee: AMP Incorporated, Harrisburg, Pa.

[21] Appl. No.: 85,443

[22] Filed: Oct. 16, 1979

[51] Int. Cl.[3] ..... H01R 13/424

[52] U.S. Cl. ..... 339/91 R; 339/176 M; 339/206 R; 339/205

[58] Field of Search ..... 339/91 R, 176 M, 204, 339/205, 206, 211, 17 C, 17 LC, 125 R, 126 R, 176 MP

[56] References Cited

U.S. PATENT DOCUMENTS

| | | | |
|---|---|---|---|
| 3,166,371 | 1/1965 | Brown et al. | 339/211 |
| 3,369,214 | 2/1968 | Krumreich et al. | 339/176 M |
| 4,153,327 | 5/1979 | Johnson | 339/205 |

*Primary Examiner*—John McQuade

*Attorney, Agent, or Firm*—Frederick W. Raring; F. Brice Faller

[57] ABSTRACT

A double-ended connector receptacle for end-to-end connection of modular plugs. Conductors extend longitudinally in channels in a frame and are bent around the frame to form spring contacts whose alignment is maintained by barrier walls extending from the frame. The connector is assembled by telescopic insertion of the frame into a tubular sheath which firmly retains the frame by latching and biasing mechanisms which are integral to the frame and the sheath. Both parts are designed to be produced in straight action molds.

11 Claims, 12 Drawing Figures

32
36
38
39
40
42
46
47
48
49
50
52
53
54
60
6
78
5
80
80'
82
84
84'
86
86'
56
58
68

ELECTRICAL CONNECTOR RECEPTACLE

FIELD OF THE INVENTION

This invention relates to electrical connector receptacles of the type adapted to receive connector plugs along a common axis within the confines of an insulating housing, particularly to end-to-end connection of modern modular plugs used to terminate multiple conductor cable.

THE PRIOR ART

U.S. Pat. No. 4,153,327 describes in detail a double-ended connector receptacle intended for use in the telephone industry. The connector described in that patent comprises three plastic parts, in addition to conductors, which are fit together to form a double-ended receptacle. The receptacle is designed to receive modular plugs of the type shown in U.S. Pat. No. 3,954,320, which are used to terminate line cords. This permits end-to-end connection of line cords so that a telephone may be located as convenience dictates.

SUMMARY

The present invention is directed to the achievement of a connector of the general type shown in U.S. Pat. No. 4,153,327, but having a two part housing which results in improved reliability, lower assembly cost, and other advantageous features discussed below.

The herein disclosed embodiment of the invention comprises a tubular housing sheath which telescopically receives a frame with parallel conductors mounted thereon. Each conductor is obtusely bent over each end of the frame and the frame is then inserted in the housing, thus forming a set of spring contacts in each end of the housing, which serve to engage corresponding contacts on inserted plugs. The frame has a medial wall extending from its center which has a plurality of barrier walls on either side to maintain the ends of the conductors in a fixed separated configuration and to prevent injury which a small child might incur if he inserted his finger into a plug receiving opening. The frame is maintained within the housing by means of latches on the housing and the frame which engage as the frame is pushed home.

An important feature of the disclosed embodiment goes to the ease by which it may be manufactured. The commonly used type of modular plug has a flexible latch integral thereto for engaging shoulders provided within a connector receptacle, commonly called a jack. Jacks known in the art are provided with two shoulders in each plug receiving opening, one for each side of the latch. This invention has but one such plug retaining shoulder in each opening, and these are located against opposite walls. This placement permits manufacture of tubular sheaths by molding the plastic, in a straight action mold, around core pins which are inserted from both ends of the sheath.

The drawings:

FIG. 5 is a cross-sectional view of the frame taken along lines 5—5 of FIG. 4.

Figure 1:
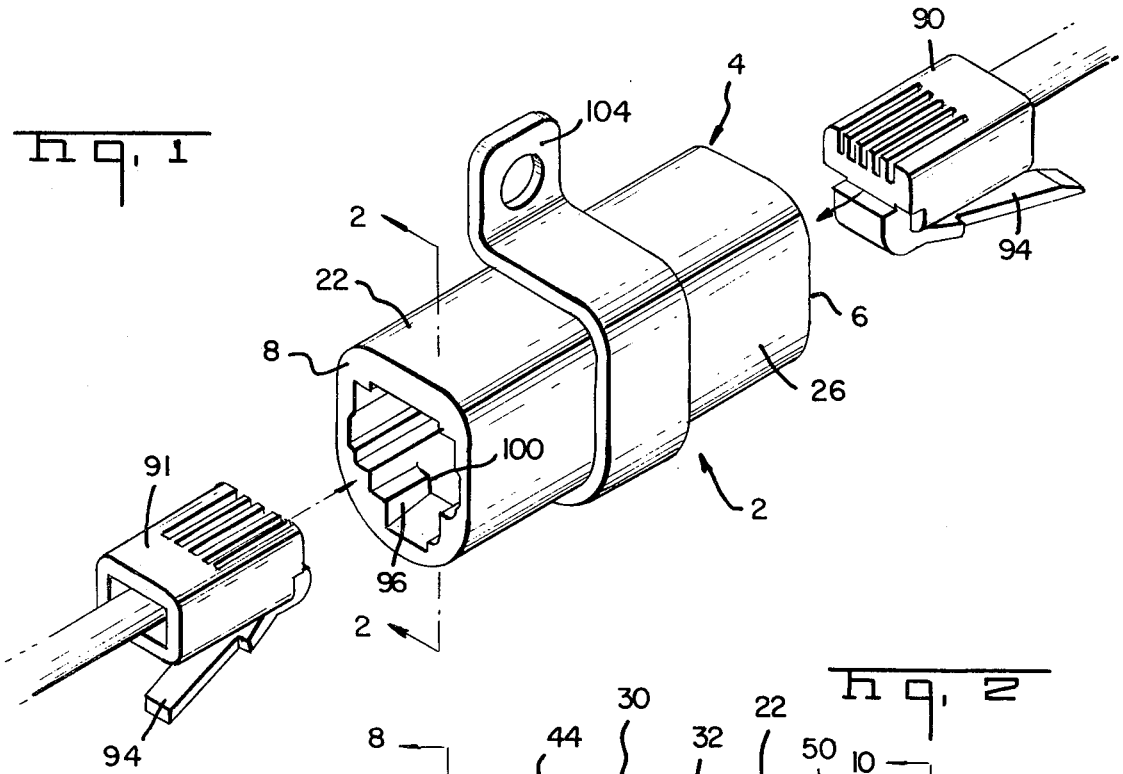
FIG. 1 is a perspective view of a connector receptacle in accordance with the invention with a mounting means and showing connector plugs exploded from the receptacle.
Figure 2:
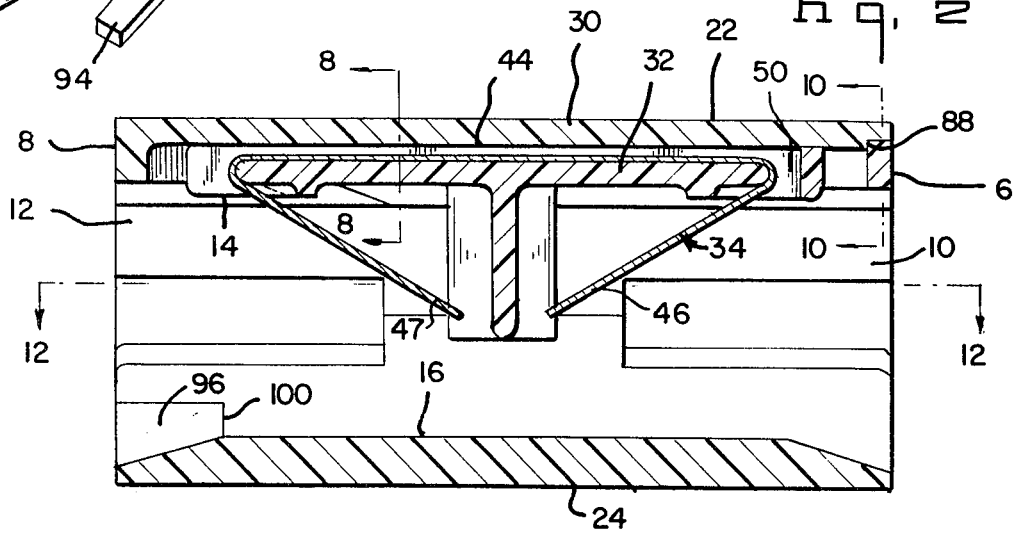
FIG. 2 is a cross-sectional view taken along the lines 2—2 of FIG. 1 but omitting the mounting means.

Referring now to the drawings, a double-ended receptacle assembly 2 comprises a housing assembly 4 having first and second plug receiving faces 6, 8 respectively thereon, and having first and second plug receiving openings 10, 12 respectively therein. These openings are defined by opposed internal sidewalls 14, 16 and opposed internal endwalls 18, 20. The housing assembly also has opposed external sidewalls 22, 24 and opposed external endwalls 26, 28. The housing assembly comprises a tubular housing sheath 30 and a housing frame 32, having conductors 34 mounted thereon, the frame being telescopically received into the sheath.

The frame 32 comprises an elongated generally rectangular web 36, having first and second ends 38, 39 which are proximate to the first and second plug receiving faces 6, 8. The web has first and second surfaces 40, 42 which extend between said ends, the second surface 42 of the web having a plurality of side-by-side channels 49 therein and extending the length thereof. Each of the conductors 34 has a first contact portion 46, a second contact portion 47, and an intermediate portion 48 extending therebetween. The intermediate portion of the conductors is in the channels and extends around the ends of the web. Each of the channels has an aperture 50 therein which is proximate to the first end 38, through which the associated conductor extends. The frame 32 further has a medial wall 52 extending from the first surface of the web and lying in a plane which is essentially perpendicular to the internal sidewalls and internal endwalls of the sheath. This medial wall has a plurality of side-by-side barrier walls 53 extending from either side thereof and perpendicular thereto. The first and second spring portions 46, 47 of each conductor extend obliquely from the intermediate portion 48 and terminate in free end portions 54, each of the free end portions being between an adjacent pair of barrier walls.

Each of the conductors comprises a single elongated strip of stamped and formed sheet metal 56 having barbs 58 formed thereon for mating with notches 60 in each of the channels 49, thus affording positive placement and retention of the conductors in the channels. This feature is shown to best advantage in FIG. 6.

Figure 3:
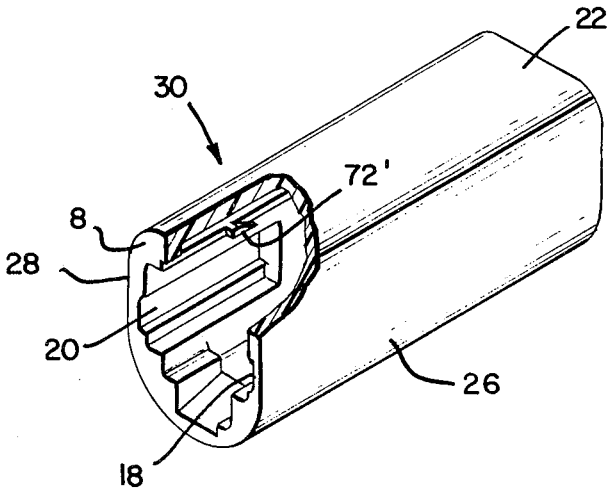
FIG. 3 is a cutaway perspective view of the tubular housing sheath showing details of the latching means for retaining the frame.
Figures 4, 6, 7:
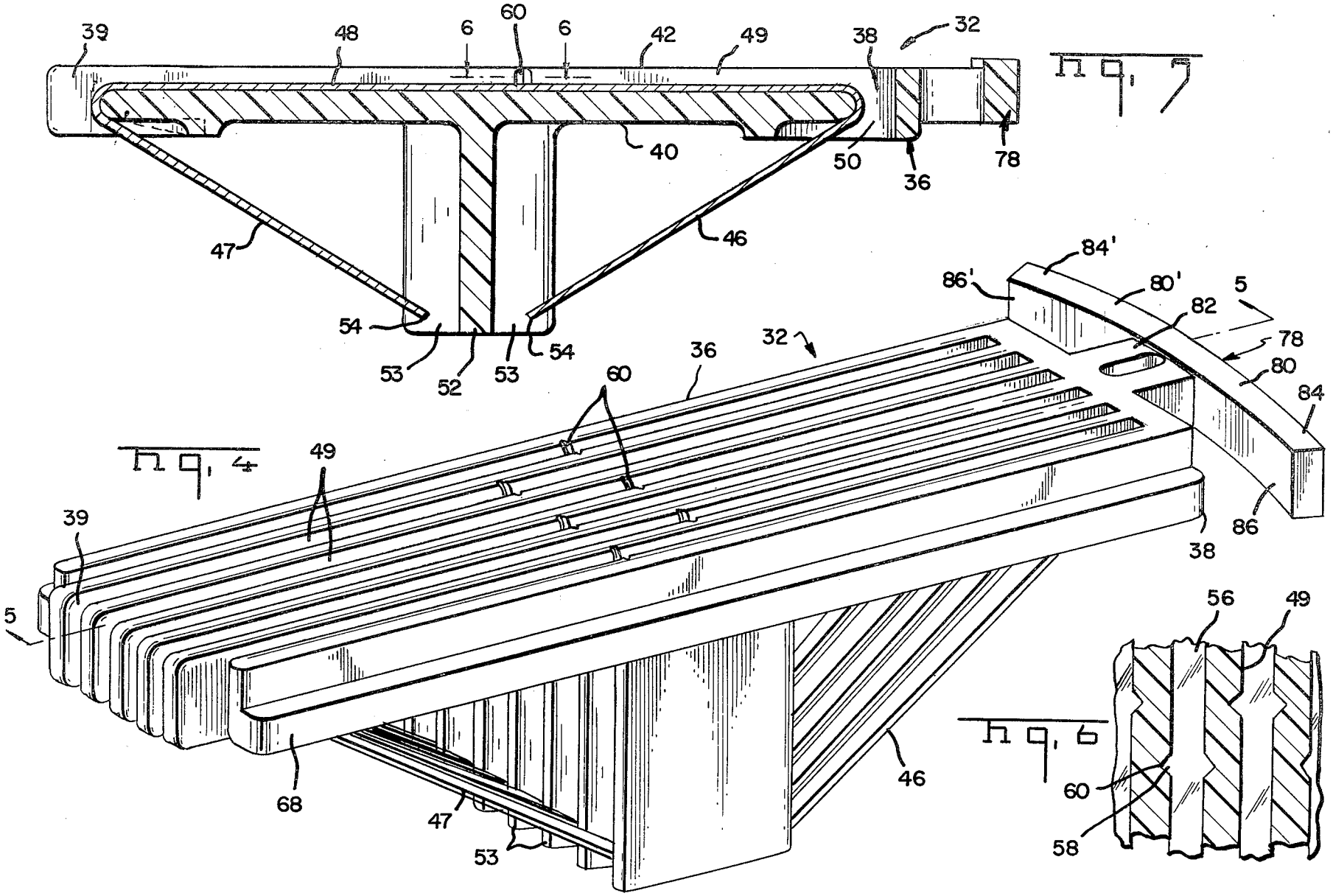
FIG. 4 is a perspective view of the frame with the conductors in place.
FIG. 6 is a fragmentary plan view of the frame taken along lines 6—6 of FIG. 5.
FIG. 7 is a fragmentary perspective view of the frame inverted from FIG. 4.
Figure 7:
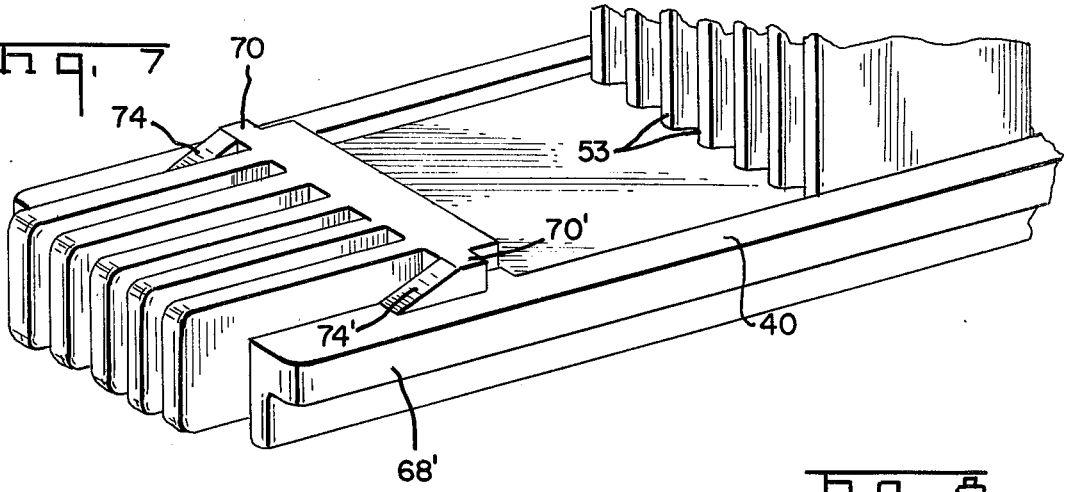
Figure 8:
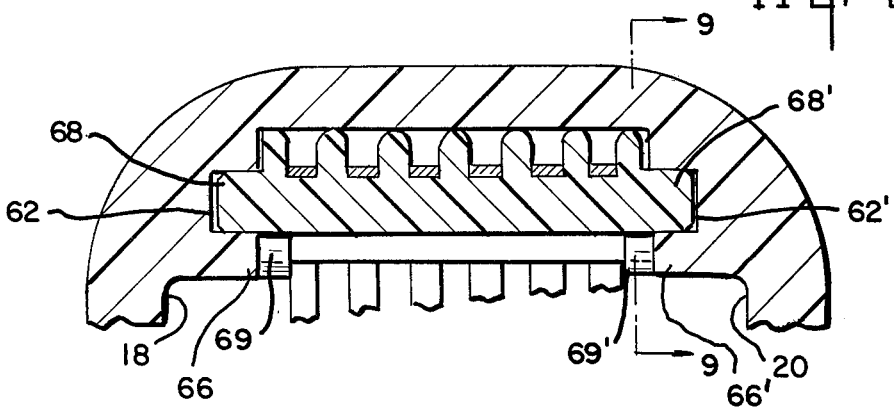
FIG. 8 is a cross-sectional view of the frame taken along the line 8—8 of FIG. 2.
Figure 9:
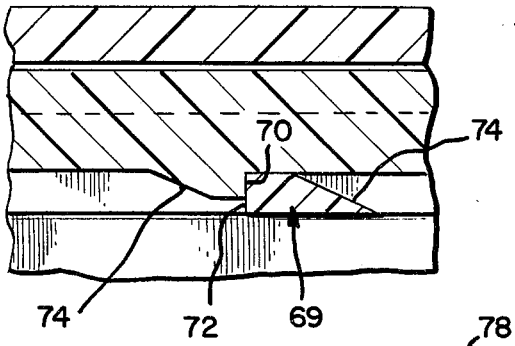
FIG. 9 is a cross-sectional view of the housing taken along line 9—9 of FIG. 8.
Figure 10:
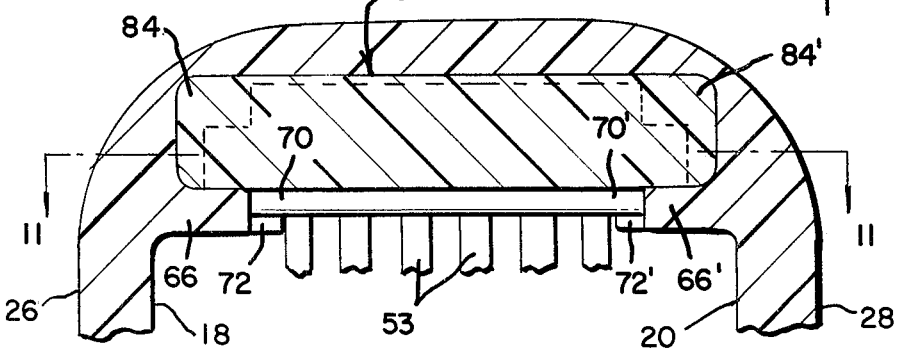
FIG. 10 is a cross sectional view of the housing taken along line 10—10 of FIG. 2.
Figure 11:
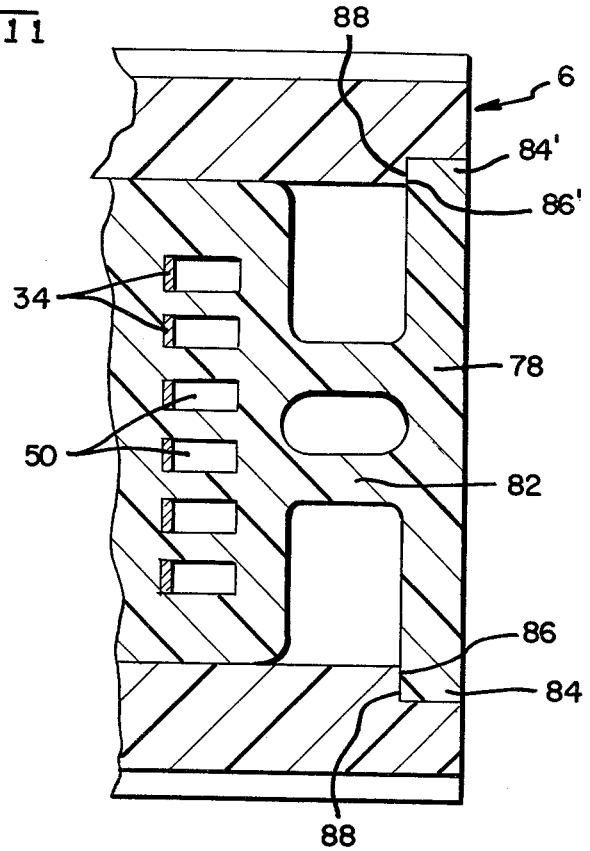
FIG. 11 is a cross-sectional view of the housing taken along line 11—11 of FIG. 10.

Once the conductors 34 have been assembled to the frame 32, the frame is ready for insertion into the sheath 30. The frame is positioned adjacent to the internal surface portions of the tubular sheath 30 by means of first and second grooves 62, 62' in the internal endwalls, each groove being in an opposing endwall and defined by ridges 66, 66' on the sheath, which extends between the first and second plug-receiving faces 6, 8. The grooves 62, 62' are profiled to closely receive ridges 68, 68' on the side edges of the frame. Once the frame is fully inserted into the sheath interengaging latching means 69 which comprise shoulder means 70, 70' on the web and opposed shoulder means 72, 72' on the sheath prevent retrograde movement of the frame from the sheath. The shoulder means 72, 72' in the tubular sheath protrude from the ridges 66, 66' on the sheath, as shown in FIG. 3. The opposed shoulder means on the web protrude from the first surface of the web proximate to the end 39 of the web as shown in FIG. 7. Each of the shoulder means on the web and on the sheath has an inclined face 74 for slideable engagement with the opposed shoulder means as the frame is inserted into the tubular sheath. The sheath flexes as the opposed inclined faces engage and pass over each other, and returns to an unflexed state when the frame is fully positioned in the tubular sheath, as shown in FIG. 9.

Resilient biasing means effective between the frame and the sheath bias the frame toward the first plug receiving face. This biasing means comprises spring means 78 integral with the frame and acts on the sheath. The spring means comprises a pair of cantilever springs 80, 80' which extend laterally from a central location on the first end 38 of the web, the apertures 50 being located inwardly on the web from the first end. The cantilever springs have free ends 84, 84' having bearing portions 86, 86' which bear against one surface 88 of the sheath when the springs are in a defected condition.

Figure 12:
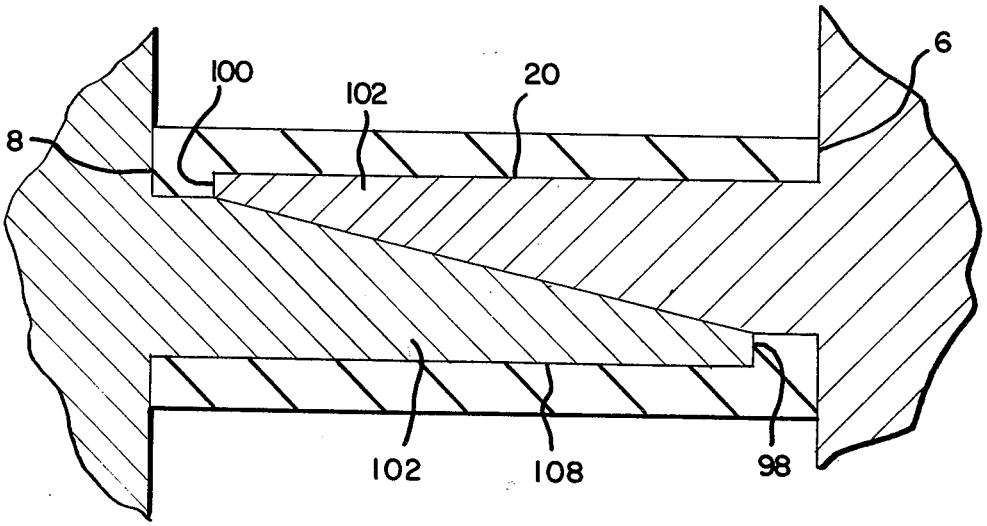
FIG. 12 is a cross-sectional view of the sheath taken along lines 12—12 of FIG. 2 showing the position of the tooling during the forming operation.

The double-ended receptacle described above is dsigned to receive plugs 90, 91 as shown in FIG. 1. The housing means has plug retaining shoulder means 96 which are designed to retain the plugs in the receptacle by cooperating with a flexible latch 94 on the plugs. The shoulder means comprises first and second plug retaining shoulders 98, 100 which are proximate to the first and second plug receiving ends respectively, the first plug receiving shoulder extending from one of the internal endwalls and the second plug retaining shoulder extending from the other internal endwall. The placement of only one shoulder against each endwall permits manufacture of tubular sheaths by molding the plastic around core pins 102 which are inserted from both ends of the sheath, as shown in FIG. 12.

An advantageous feature of double-ended receptacles in accordance with the invention is that each of the two parts can be produced by relatively simple injection molding processes of thermoplastic material, such as a suitable nylon composition. Moreover, both parts can be produced in straight-action molds, that is, in molds having core pins which extend only in the direction of movement of the mold parts during opening and closing. It will be apparent from an inspection of FIG. 5 that the frame 32 has recesses which extend only normally of the plane defined by the web portion, see also FIGS. 4 and 7, and there are no recesses or openings which extend transversely through the web portion or the medial wall 52 which would require core pins extending normally of the direction of movement of the mold parts. Similarly, the housing sheath can be produced in a straight-action mold by virture of the fact that one shoulder is provided adjacent to each of the plug receiving ends 6, 8, and these shoulders are provided on opposite endwalls of the housing. Core pins can thus be designed such that they extend through the mold cavity and engage each other when the mold is closed. The achievement of a straight-action mold technique reduces the production cost of any molded part and thereby contributes to the low production cost which can be realized in accordance with the practice of the invention.

A further advantageous feature is that the conductors are stamped and formed sheet metal such as brass, rather than wire, as is common practice in the manufacture of receptacles of the type which accept plugs, as shown at 90 and 91. Assembly of the conductors to the housing frame 32 can therefore be carried out by simply shearing the required number of conductors from an endless strip of stamped conductors, bending the contact portions 46 of the conductors normally of the intermediate portions 48 and inserting all of the conductors through the apertures 50. At the same time, the intermediate portions 48 are moved into the channels 49. The contact portions 46, 47 are then bent inwardly until they are in the positions shown in FIG. 5. Assembly of the housing frame to the housing sheath is also a relatively simple operation, in that it simply requires that the frame be moved axially and telescopically into the sheath until the shoulders 70, 72 are against each other and the ends 84 of the springs 80 are against the shoulders 88 of the housing sheath.

I claim:

1. A double-ended receptacle of the general type comprising a housing assembly having oppositely directed first and second plug-receiving faces, a plug-receiving opening extending into each of said plug-receiving faces, each of said openings having opposed internal sidewalls and opposed internal endwalls, said housing assembly having opposed external sidewalls and opposed external endwalls, a plurality of parallel side-by-side conductors, each of said conductors having a first and second contact portion and an intermediate portion, said intermediate portion of each conductor being disposed in said housing assembly between one of said internal sidewalls and the one external side-wall which is adjacent to said one internal sidewall, each of said first and second contact portions emerging from said one internal sidewall at a location proximate to said first and second faces respectively and extending obliquely inward of its respective opening and towards the other internal sidewall, said receptacle being dimensioned to receive a connector plug in each of said first and second plug-receiving openings, said plugs having contact members therein which are engageable with said contact portions of said conductors, said receptacle being characterized in that:

said housing assembly comprises a housing frame and a tubular housing sheath, said housing frame being telescopically received in said housing sheath, said housing frame comprises an elongated web which extends between said plug-receiving faces, said web having ends which are proximate to said faces, said web having first and second surfaces which extend between said ends, said first surface constituting said one internal sidewall, said second surface being proximate to internal surface portions of said sheath, a medial wall integral with, and extending from said first surface, said medial wall lying in a plane which is essentially perpendicular to said internal sidewalls and said internal endwalls, recesses in the sides of said medial wall, said first and second contact portions of said conductors having free end portions which are received in, and captured by, said recesses, said intermediate portions of said conductors being between said second surface of said web and said internal surface portions of said sheath, said intermediate portions extending around said ends of said web, and interengaging latching means on said frame and on said sheath, said latching means being spaced inwardly from said first plug-receiving face, said latching means being effective to prevent retrograde movement of said frame from its inserted position, whereby said housing frame is maintained in said tubular sheath in a predetermined position between said faces by said latching means.

2. A double-ended receptacle as set forth in claim 1, said latching means comprising opposed shoulders on said web and on said housing sheath.

3. A double-ended receptacle as set forth in either of claims 1 or 2, said housing assembly having plug retaining shoulder means which are cooperable with inserted plugs to retain said plugs in said receptacle, said plug retaining shoulder means comprising first and second plug retaining shoulders which are proximate to said first and second plug receiving faces respectively, said first plug retaining shoulder extending from one of said internal endwalls, and said second plug retaining shoulder extending from the other one of said internal endwalls.

4. A double-ended receptacle of the general type comprising a housing assembly having oppositely directed first and second plug-receiving faces, a plug-receiving opening extending into each of said plug-receiving faces, each of said openings having opposed internal sidewalls and opposed internal endwalls, said housing assembly having opposed external sidewalls and opposed external endwalls, a plurality of parallel side-by-side conductors, each of said conductors having a first and second contact portion and an intermediate portion, said intermediate portion of each conductor being disposed in said housing assembly between one of said internal sidewalls and the one external sidewall which is adjacent to said one internal sidewall, each of said first and second contact portions emerging from said one internal sidewall at a location proximate to said first and second faces respectively and extending obliquely inward of its respective opening and towards the other internal sidewall, said receptacle being dimensioned to receive a connector plug in each of said first and second plug-receiving openings, said plugs having contact members therein which are engageable with said contact portions of said conductors, said receptacle being characterized in that:

said housing assembly comprises a housing frame and a tubular housing sheath, said housing frame being telescopically received in said housing sheath, said housing frame comprises an elongated web which extends between said plug-receiving faces, said web having ends which are proximate to said faces, said web having first and second surfaces which extend between said ends, said first surface constituting said one internal sidewall, said second surface being proximate to internal surface portions of said sheath, a medial wall integral with, and extending from said first surface, said medial wall lying in a plane which is essentially perpendicular to said internal sidewalls and said internal endwalls, recesses in the sides of said medial wall, said first and second contact portions of said conductors having free end portions which are received in, and captured by, said recesses, said intermediate portions of said conductors being between said second surface of said web and said internal surface portions of said housing sheath, said intermediate portions extending around said ends of said web, said contact portions extending from said ends of said web, said housing frame being inserted into said sheath from said first face towards said second face, interengaging latching means on said frame and on said sheath, said latching means being spaced inwardly from said first face, said latching means being effective to prevent movement of said frame from its inserted position, and resilient biasing means effective between said frame and the sheath, said biasing means being effective to bias said frame towards said first face whereby, said housing frame is maintained immovably in said tubular sheath in a predetermined position between said faces by said latching means and said biasing means.

5. A double-ended receptacle as set forth in claim 4, said latching means comprising opposed shoulder means on said web and on said tubular sheath, said biasing means comprising spring means integral with said frame, said spring means being in a deflected condition and having bearing portions which are against said tubular sheath.

6. A double-ended receptacle as set forth in claim 5, said spring means comprising a pair of cantilever springs, said springs extending laterally from a central location on said web at said first end towards said sheath, said cantilever springs having free ends, said bearing portions being at said free ends.

7. A double-ended receptacle as set forth in claim 5, wherein said frame is positioned adjacent to said internal surface portions of said tubular sheath by means of first and second grooves in said internal endwalls, said first groove formed in one internal endwall and said second groove formed in the other internal endwall, each groove being defined by a ridge on said sheath and extending between said first and second plug-receiving faces, each groove being profiled to closely receive a ridge on an adjacent portion of said frame, said shoulder means in said tubular sheath protruding from said ridge on said sheath, said opposed shoulder means on said web protruding from said first surface of said web, each said shoulder means having an inclined face for slideable engagement with said opposed shoulder means as said frame is inserted in said tubular sheath, said ridge on said sheath flexing as said opposed inclined faces engage and returning to an unflexed state when the frame is fully positioned in the tubular sheath.

8. A double-ended receptacle as set forth in claim 4, wherein said second surface of said web has a plurality of side-by-side channels therein extending between said ends, said intermediate portions of said conductors being in said channels.

9. A double-ended receptacle as in claim 8, wherein each of said conductors comprises a single elongated strip of stamped and formed sheet metal.

10. A double-ended receptacle as set forth in claim 9, said web having a plurality, equal to the number of said channels, of apertures therein proximate to said first face, each of said aperture being in one of said channels, said conductors extending through said apertures.

11. A double-ended receptacle as set forth in claim 10, said resilient means comprising a pair of cantilever springs extending laterally from a central location on said web at said first end, said apertures being located inwardly on said web from said first end, said cantilever springs having free ends, said cantilever springs being in a deflected condition with said free ends bearing against said sheath.

* * * * *